United States Patent [19]

Metoki et al.

[11] Patent Number: 4,925,783

[45] Date of Patent: May 15, 1990

[54] HIGH SENSITIVITY LIGHT-SENSITIVE SILVER HALIDE PHOTOGRAPHIC MATERIAL WITH LITTLE STAIN

[75] Inventors: Iku Metoki; Chika Honda; Yasunori Wada, all of Hino, Japan

[73] Assignee: Konica Corporation, Tokyo, Japan

[21] Appl. No.: 190,260

[22] Filed: May 2, 1988

[30] Foreign Application Priority Data

May 15, 1987 [JP] Japan ..... 62-119381

[51] Int. Cl.[5] ..... G03C 1/12

[52] U.S. Cl. ..... 430/569; 430/570

[58] Field of Search ..... 430/569, 567, 570

[56] References Cited

U.S. PATENT DOCUMENTS 2,618,556 11/1952 Hewitson et al. ..... 430/569
3,573,919 4/1971 Bigelow ..... 430/569
4,225,666 9/1980 Locker et al. ..... 430/569
4,693,965 9/1987 Ihama et al. ..... 430/569
4,791,053 12/1988 Ogawa ..... 430/581

*Primary Examiner*—Paul R. Michl
*Assistant Examiner*—Mark R. Buscher
*Attorney, Agent, or Firm*—Frishauf, Holtz, Goodman & Woodward

[57] ABSTRACT

Disclosed is a light-sensitive silver halide photographic material having at least one layer comprising a silver halide photographic emulsion, wherein the silver halide photographic emulsion is obtained by addition of a spectral sensitizing dye during the desalting step in obtaining the emulsion.

According to the present invention, there can be obtained a highly sensitive light-sensitive material with little stain, good pressure blackening performance and yet great absorption of the dye.

13 Claims, No Drawings

HIGH SENSITIVITY LIGHT-SENSITIVE SILVER HALIDE PHOTOGRAPHIC MATERIAL WITH LITTLE STAIN

BACKGROUND OF THE INVENTION

This invention relates to a light-sensitive silver halide photographic material, particularly to a high sensitivity light-sensitive silver halide photographic material with little stain.

In the field of light-sensitive silver halide photographic materials, it has been practiced to add a spectral sensitizing dye for photography in the photographic emulsion constituting the light-sensitive material.

In preparation of silver halide emulsions, the procedure generally comprises passing through the steps of formation of silver halide grains, physical ripening, desalting and chemical sensitization, etc. During such steps, the timing at which a spectral sensitizing dye is added to the emulsion may be selected variously, but as the technique in the prior art, there is first the technique in which it is performed before coating after chemical sensitization, or before initiation of chemical sensitization or in the course of chemical sensitization as disclosed in U.S. Pat. No. 4,425,426. Further, secondly, as disclosed in U.S. Pat. Nos. 2,735,766, 3,628,960, 4,183,756, 4,225,666, Japanese Unexamined Patent Publications Nos. 26589/1980 and 184142/1983, there is the technique in which it is added in the course of forming grains (during physical ripening). Thirdly, as disclosed in Japanese Unexamined Patent Publications Nos. 103149/1986 and 196238/1986, there is the technique in which it is added in the latter half of grain growth when the shape of the grain is not substantially changed, and after formation of grains before the desalting step. However, the above first technique of the prior art has the problem that it can be applied only for the case when a dye having high sensitizing ability and strong adsorption power is used, because adsorption of the dye to silver halide is weak. The above second technique of the prior art may sometimes suffer from obstruction of normal crystal growth due to adsorption of the dye on the grain surface during growth, since a dye is added in the course of grain formation. Also, since the first to the third techniques of the prior art as mentioned above all perform formation of grains and adsorption of the dye, while having grains dispersed and adsorbed in a hydrophilic colloid, the amount of the dye adsorbed is insufficient and not satisfactory.

Also, the conventional light-sensitive material to which a spectral sensitizing dye is added has not sufficiently solved the problem of stain. Particularly, when the amount of the dye is not sufficient as described above, an attempt to increase the adsorption amount may sometimes result in pronounced stain.

Further, the light-sensitive material of the prior art involves the problem that the performance to the so called pressure blackening, in which blackening occurs under pressure generated, for example, when the light-sensitive material is bent, is not sufficient.

An object of the present invention is to provide a light-sensitive silver halide photographic material spectrally sensitized, which is a high sensitivity light-sensitive photographic material increased in the adsorbed amount of a spectral sensitizing dye, and yet with little stain and good pressure blackening performance.

SUMMARY OF THE INVENTION

In order to accomplish the object as mentioned above, the present invention is constituted by a light-sensitive silver halide photographic material having at least one layer comprising a silver halide photographic emulsion, wherein said silver halide photographic emulsion is obtained by addition of a spectral sensitizing dye during the desalting step in obtaining said emulsion.

The light-sensitive material of the present invention has at least one emulsion layer formed with an emulsion obtained by addition of a spectral sensitizing dye during the desalting step, and by such constitution, there can be obtained a highly sensitive light-sensitive material with little stain, good pressure blackening performance and yet great absorption of the dye, in which the above mentioned object has been attained.

DESCRIPTION OF THE PREFERRED EMBODIMENTS

In the present invention, the light-sensitive emulsion layer often comprises several kinds of emulsions blended with each other, and in such a case, it is only required that at least one of the blended emulsions is the emulsion according to the present invention.

Further, in the present invention, the desalting step refers to the step for removing soluble salts which is performed after completing the formation of emulsion grains (after precipitation formation or after physical ripening).

More specifically, silver halide photographic emulsions are generally prepared by passing through the respective steps of formation of silver halide grains by such means as double decomposition of soluble silver salts and soluble halides in an aqueous gelatin solution, physical ripening, and desalting, followed further by chemical sensitization. Among such steps, removal of salts performed after completion of formation of the above silver halide grains, namely after formation of precipitation or further after completion of physical ripening is called the desalting step.

Ordinarily in the desalting step, a series of operations of addition of a desalting agent, stationary standing and decantation are carried out at least once, usually repeated several times, and thereafter dispersed generally with addition of post-gelatin (as described later), followed by entering of the chemical sensitization process on completion of such operations. The desalting step as mentioned in the present invention refers to the step after precipitation formation or physical ripening before entering of the chemical sensitization (including at least the post-gelatin addition step).

There are various desalting means, such as the Noodel water washing method which has been known for a long time and is practiced by gelling gelatin, and also the precipitation method (flocculation) by utilizing inorganic salts comprising polyvalent anions (e.g. sulfates such as sodium sulfate), anionic surfactants, anionic polymers (e.g. polystyrene sulfonate), or gelatin derivatives (e.g. aliphatic acylated gelatin, aromatic acylated gelatin, aromatic carbamoylated gelatin, etc.).

A preferable desalting means is to employ a sulfate ($MgSO_4$, $Na_2SO_4$ and others) as the desalting agent, or to use an anionic polymer (e.g. polystyrylsulfonic acid type polymer as disclosed in Japanese Patent Publication No. 16086/1960 or a vinyl polymer having carboxylic acid in the side chain as disclosed in Japanese Unexamined Patent Publication No. 32445/1987).

The point (addition position) at which the spectral sensitizing dye is added may be any desired point during the desalting step. Preferably, it is added before entering of post-gelatin, namely before entering of the gelatin to be added for dispersing again the silver halide grains after desalting. Further, the same and/or another spectral sensitizing dye may be also added to the silver halide grains thus obtained before or after chemical sensitization.

Any desirable method for addition of the spectral sensitizing may be available, and, for example, a spectral sensitizing dye can be added into the emulsion as dissolved in water or an organic solvent. Substantially water-insoluble spectral sensitizing dyes can be used as dispersions dispersed in water-insoluble solvents. The spectral sensitizing dye may be added in the whole amount all at once, or in some divided portions, or alternatively continuously for a predetermined period of time.

The pH of the emulsion during the desalting step may be preferably 3.5 to 9.5, and the spectral sensitizing dye may be added in said step preferably at the point when pH is 6.0 to 9.5.

The pAg of the emulsion during the desalting step may be preferably 4.9 to 12.5, and similarly the spectral sensitizing dye may be added preferably at the point when pAg is 8.0 to 12.5.

As the spectral sensitizing dye, various dyes can be used. For example, there can be used cyanine dyes, merocyanine dyes, complex cyanine dyes, complex merocyanine dyes, holopolar cyanine dyes, hemicyanine dyes, styryl dyes or hemioxanol dyes.

Particularly useful dyes are cyanine dyes, merocyanine dyes, and complex merocyanine dyes. For these dyes, any of nuclei conventionally utilized as the basic heterocyclic ring nucleus for cyanine dyes is applicable. More specifically, there may be included pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus and nuclei having alicyclic hydrocarbon rings fused to these nuclei; and nuclei having aromatic hydrocarbon rings fused to these nuclei, namely indolenine nucleus, benzindolenine nucleus, indole nucleus, benzoxazole nucleus, naphthaoxazole nucleus, benzothiazole nucleus, naphthothiazole nucleus, benzoselenazole nucleus, benzimidazole nucleus, quinoline nucleus, etc. These nuclei may be substituted on the carbon atoms.

For melocyanine dyes or complex melocyanine dyes, as the nucleus having a ketomethylene structure, 5- to 6-membered heterocyclic nucleus such as pyrazoline-5-one nucleus, thiohydantoin nucleus, 2-thiooxazolidine-2,4-dione nucleus, thiazolidine-2,4-dione nucleus, rhodanine nucleus, thiobarbituric acid nucleus, etc. can be applied.

These sensitizing dyes may be also used alone, but they can be also used in combination.

Specifically, for example, the dyes described in RD (Research Disclosure), 17643, p. 22–24, RD 18716, p.648, right col. et seq, or dyes disclosed in Japanese Unexamined Patent Publication No. 80237/1986 can be preferably used.

The silver halide grains in the above emulsion according to the present invention may have any desired composition, including for example silver halides such as silver chloroiodobromide, silver chloride, silver chlorobromide, silver bromide, silver iodobromide, silver iodide, etc. With respect to high sensitivity, silver iodobromide is preferred. Further, the average silver iodide content in the silver iodobromide may be preferably 0.1 to 10 mol%, particularly preferably 1 to 8 mol%.

Said silver halide grains should preferably have an average grain size of 0.2 to 8.0 μm, more preferably 0.3 to 1.5 μm.

The inner structure of said silver halide grain may be any desired one, but one having a multi-layer structure of two or more layers can be preferably used. In this case, one having layers with a difference in silver iodide (AgI) content between the adjacent layers larger by 20 mol% or more than the internal layer of the grain may be preferred. Also, it is preferred that each layer should be constituted of silver bromide or silver iodobromide. The localized portion containing a high concentration of silver iodide of 20 mol% or more localized therein should be preferably located at the innerside from the outer surface of the grain as far as possible, and it is particularly preferred that the localized portion should exist at the portion apart by 0.01 μm or more from the outer surface. The emulsion according to the present invention may be either mono-dispersed emulsion or poly-dispersed emulsion, but it is preferably made mono-dispersed dispersion. By doing so, sensitization treatment such as chemical sensitization, etc. can be sufficiently applied to give extremely high sensitivity, and yet hard tone can be obtained with little softening of the tone by the sensitization treatment.

For preparation of a mono-dispersed emulsion, crystal growth is generally performed first. In crystal growth, both of silver ion and halide solutions may be added alternately in time series, but they are preferably conducted according to the so called double jet method.

For obtaining a mono-dispersed emulsion, it is particularly preferable to use seed crystals and permit grains to grow by supplying silver ions and halide ions with the seed crystals a the growth nuclei.

The grain size distribution after grain growth will become broader as the grain size distribution of the seed crystals is broader. Accordingly, for obtaining a mono-dispersed emulsion, it is preferable to use crystals with narrow grain size distribution at the stage of seed crystals.

Silver halide emulsion is generally applied with chemical sensitization to sensitize the grain surfaces, but in the case of applying chemical sensitization after the desalting step in the present invention, at least a part of the spectral sensitizing dye is already added in the emulsion. When chemical sensitization is applied in the present invention, it can be practiced according to the sulfur sensitization method by use of a compound containing sulfur capable of reacting with silver ions and an active gelatin, the reduction sensitization method by use of a reductive substance, the noble metal method sensitization method by use of a noble metal compound such as gold and others, either alone or in combination. Preferably, gold sensitization and sulfur sensitization are used in combination. As the sulfur sensitizing agent, thiosulfates, thioureas, thiazoles, rhodanines, and other compounds can be used. As the reduction sensitizing agent, stannous salts, amines, hydrazine derivatives, formamidinesulfinic acid, silane compounds, etc. can be used. For noble metal sensitization, besides gold complexes, complexes of metals of the group VIII of the periodic table such as platinum, iridium, palladium, etc. can be used.

The amount of silver coated may be as desired, but preferably from 1000 mg/m$^2$ to 15000 mg/m$^2$, more preferably from 2000 mg/m$^2$ to 10000 mg/m$^2$ As the binder or protective colloid in the photographic emulsion according to the present invention, gelatin may be advantageously used, but also other hydrophilic colloids can be used.

The present light-sensitive material contains at least one emulsion layer comprising the emulsion according to the present invention as described above. The emulsion layer is generally provided by coating a support with the emulsion, said emulsion layer may be formed either on one surface or both surfaces of the support, and the layer comprising the emulsion according to the present invention may exist as at least one layer on either side. Layers comprising an emulsion other than the emulsion according to the present invention may also be present. Also, other non-light-sensitive layers such as protective layer, intermediate layer, etc. may also exist as a matter of course.

The basic method for preparation of the above emulsion according to the present invention or other emulsions to be used optionally in the light-sensitive material according to the present invention may be any desired one. For example, either of the acidic method, the neutral method, the ammonia method, etc. may be employed, or as the system for reacting a soluble silver salt with a soluble halide salt, either the one side mixing method, the simultaneous mixing method or the combination thereof may be employed. It is also possible to employ the method in which grains are formed under excess of silver ions (the so called reverse mixing method). As one system of the simultaneous mixing method, the method in which pAg in the liquid layer where silver halide is formed is maintained constant, namely the so called controlled double jet method can be also used. As described above, according to this method, a silver halide emulsion with regular crystal forms and substantially uniform grain sizes can be preferably obtained.

Two or more kinds of silver halide emulsions separately formed may be also used as a mixture.

Also, flat plate grains with an aspect ratio of 5 or more can be used as the silver halide grains in the emulsion. Said flat plate grains may also assume a layered structure as described above.

Mixtures of grains of various crystalline forms may be also available.

In the process of formation or physical ripening of silver halide grains, cadmium salt, zinc salt, lead salt, thallium salt, iridium salt or complexes thereof, rhodium salt or complex thereof, iron salt or iron complex salt, etc., may be also permitted to coexist.

During formation of silver halide grains, for controlling growth of the grains, a solvent for silver halide such as ammonia, thioether compounds, thion compounds, etc. may be employed.

In obtaining an emulsion, the properties of the silver halide grains can be controlled by permitting various compounds to exist in the formation process of silver halide precipitates. Such compounds may be allowed to exist initially in the reactor, or may be also added together with one or two or more salts according to a conventional method. The characteristics of the silver halide can be also controlled by permitting compounds of copper, iridium, lead, bismuth, cadmium, zinc, gold and the group VIII noble metals or spectral sensitizing dyes to exist in the formation process of silver halide precipitates.

The additives to be used in the steps for preparation of the emulsion, in addition to those as mentioned above, are also described in Research Disclosures vol. 176, No. 17643 (December, 1978) and vol. 187, No. 18716 (November, 1976), and their corresponding portions are summarized in the following Table.

Known additives for photography available in preparation of the light-sensitive emulsion in practicing the present invention are also described in the above two Research Disclosures, and the described portions are shown in the following Table.

| | Kind of additive | RD17643 | RD18716 |
|---|---|---|---|
| 1. | Chemical sensitizer | p. 23 | p. 648, r. col. - |
| 2. | Sensitivity enhancer | | " |
| 3. | Spectral sensitizer, supersensitizer | p. 22–24 | p. 648, r. col. - p. 649m r. col. |
| 4. | Optical brightener | p. 24 | |
| 5. | Antifoggant and stabilizer | p. 24–25 | p. 649, r. col. |
| 6. | Color coupler | p. 25 | p. 649, r. col. |
| 7. | Organic solvent | p. 25 | |
| 8. | Light absorber, filter dye, UV-ray absorber | p. 25–26 | p. 649, r. col - p. 650, l. col. |
| 9. | Antistaining agent | p. 25, r. col. | p. 650 l.-r. col. |
| 10. | Dye image stabilizer | p. 25 | p. 651, r. col. |
| 11. | Film hardener | p. 26 | p. 651, l. col. |
| 12. | Binder | p. 26 | " |
| 13. | Plasticizer, lubricant | p. 27 | p. 650, r. col. |
| 14. | Coating aid, surfactant | p. 26–17 | " |
| 15. | Antistatic agent | p. 27 | " |

The present invention is described in more detail by referring to Examples. However, as a matter of course, the present invention is not limited at all by the Examples described below.

The compounds and the sensitizing dyes to be used in the respective Examples shown below are as follows.

Compound (I)

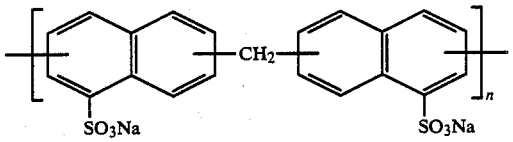

(n = 2.2)

Compound (II)

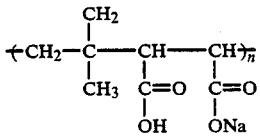

(n = 300)

-continued

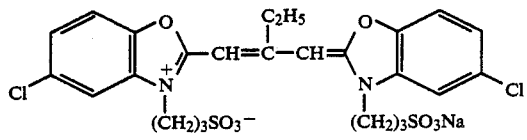

Sensitizing dye (A)

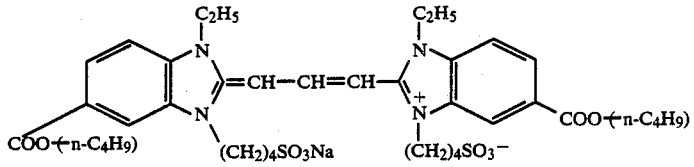

Sensitizing dye (B)

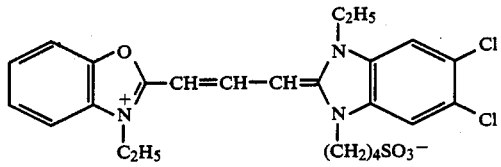

Sensitizing dye (C)

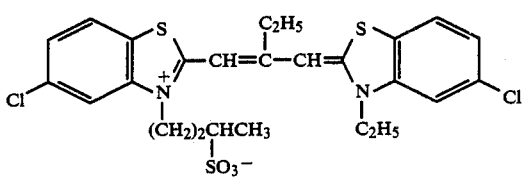

Sensitizing dye (D)

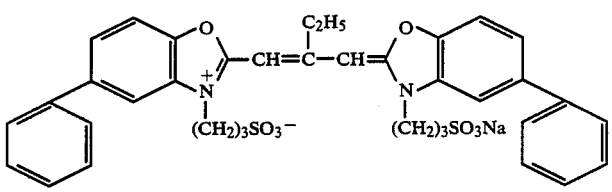

Sensitizing dye (E)

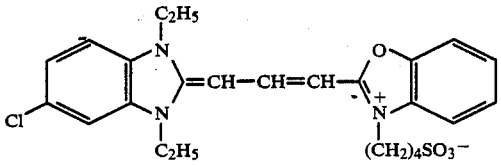

Sensitizing dye (F)

EXAMPLE 1

A mono-dispersed cubic crystal emulsion (A) of silver iodobromide containing 2 mol% of silver iodide with an average grain size of 0.3 μm was obtained according to the double jet method while controlling the conditions to 60° C., pAg=8, pH=2.0. According to electron microscope photograph, the emulsion (A) was found to contain 1% or less in number of twin crystals generated. By use of the emulsion (A) as the seed crystal, the grains as described below were grown.

That is, the emulsion (A) for the seed grain was dissolved in 8.5 liters of a solution containing protective gelatin and optionally ammonia maintained at 40° C., and further pH was adjusted with acetic acid. With this solution as the mother liquor, a 3.2 N aqueous ammoniacal silver ion solution was added according to the double jet method.

In this case, pH and EAg were varied by silver iodide content and crystal habit as occasionally demanded.

In other words, with pAg being controlled at 7.3 and pH at 9.7, a layer with a silver iodide content of 35 mol% was formed (step 1). Then, pH was varied from 9 to 8, and the layer of silver bromide was formed. At this time, pAg was maintained at 9.0 to the time when 95% of the grain size was formed (step 2), and thereafter pAg was dropped to 11.0 by adding a potassium bromide solution over 8 minutes through a nozzle and mixing was completed 3 minutes after completion of addition of the potassium bromide (step 3). Next, pH was adjusted to 6.0 with acetic acid (step 4). The emulsion 1-1 thus obtained had an average grain size of 0.65 μm and a silver iodide content in the whole grains of about 2 mol%. Subsequently, for removing excessive soluble salts in the reaction mixture, desalting step was performed. That is, with the reaction mixture being maintained at 40° C., 5 g/AgX-1mol of the compound (I) and 8 g/AgX-1mol of $MgSO_4$ were added and stirred for 5 minutes, followed by standing stationarily. Subsequently, the supernatant was removed to make up a liquid amount of 200cc/AgX-1 mol. Next, 1.8 liter-/AgX-lmol of pure water of 40° C. was added, and the mixture was stirred for 5 minutes (step 5).

As the next step, 20 g/AgX-1mol of $MgSO_4$ was added, the mixture was stirred similarly as above and left to stand and, with the supernatant being removed, desalting was conducted. Then, the solution was stirred (step 6). After stirring, post-gelatin for dispersing again AgX was added and dispersion was effected at 55° C.

For the emulsion obtained, the following chemical sensitization was applied. That is, first the emulsion was maintained at 55° C. (step 7). Then, ammonium thiocyanate, chloroauric acid and hypo were added to effect gold-sulfur sensitization. After completion of the sensitization, 4-hydroxy-6-methyl-l,3,3a,7-tetrazaindene was added (step 8).

In the present invention, in the desalting step, namely the steps 5, 6 in the above case (and thereafter prior to entering the step of applying chemical sensitization with addition of gelatin), a sensitizing dye is added to obtain an emulsion. For the purpose of observing the change in photographic performance depending on the position where it is added, samples were prepared by varying the timing at which said sensitizing dye was added. More specifically, by preparing emulsions with addition of a sensitizing dye finally in each step of the respective steps as described above, respective emulsions for samples No. 1-20 shown in Table 1 were obtained. The numerals of the steps showing the addition positions for the dyes, the kinds and amounts of sensitizing dyes are also shown in Table 1.

To the emulsion obtained as described above, a conventional amount of a conventional stabilizer, namely $2\times10^{-2}$/mol AgX of 4-hydroxy-6-methyl-l,3,3a,7-tetrazaindene was added, and further similarly conventional amounts of conventional inhibitor and other conventional stabilizer, film hardener, coating aid were added, and thereafter the emulsion was coated as described below on polyethyleneterephthalate base which was a support. That is, with the use of an aqueous dispersion of a copolymer obtained by diluting a copolymer comprising 50 wt.% of glycidyl methacrylate, 10 wt.% of methyl acrylate and 40 wt.% of butyl methacrylate so as to give its concentration of 10 wt.% as the subbing solution, this was coated on the polyethyleneterephthalate base. On the film base thus obtained, the above emulsion was coated together with a gelatin protective layer containing a conventional antistatic agent and conventional matting agent, coating aid and film hardener on both surfaces uniformly, followed by drying, to give samples No. 1 - 20.

Of the samples obtained, the samples No. 1-17 were subjected to white light exposure in which non-filter exposure was effected with the use of the standard light B described on page 39 of "New Edition-Data Book of Illumination" (edited by Corporation Society of Illumination, First Edition, Second Print) as the light source for an exposure time of 1 sec. at 3.2 CMS, and green light exposure in which exposure was effected under the same conditions with insertion of "Latten Filter No. 58" (produced by Eastman Kodak Co.) at an optical path of 15 cm from the light source.

These samples were processed for 90 seconds with XD-90 developing processing liquor by use of an automatic developing machine KX-500 produced by Konishiroku Photo Industry Co. to determine sensitivities of the respective samples. Sensitivity is determined by determining the reciprocal number of the dose necessary for increasing the blackening density by 1.0 by exposure, and represented in terms of relative values to the respective sensitivities of sample No. 9 in Table 1 as being 100 for both white light exposure and green light exposure.

For the samples 18-20, exposure was effected by use of a gelatin filter SC 52 produced by Fuji Photographic Film K.K. in place of "Latten Filter No. 58". The respective white sensitivities and red sensitivities are shown in Table 1 (in this case, the respective sensitivities of No. 20 were made 100).

As for stain, for all the samples, stain characteristic was measured by observation with eyes, and represented in 3 ranks from small staining, namely 1 representing the smallest color staining and 3 the greatest.

TABLE 1

| Sample No. | Emulsion No. | Addition position for sensitizing dye | Kind of sensitizing dye | Amount of sensitizing dye (mg/AgX-1 mol) | Sensitivity: White exposure | Sensitivity: Green exposure | Sensitivity: Red exposure | Stain | Invention or Comparative |
|---|---|---|---|---|---|---|---|---|---|
| 1 | 1-1 | Step 1 | (A) + (B)* | 300 + 15** | 100 | 100 | — | 2 | Comparative |
| 2 | 1-2 | Step 2 | (A) + (B)* | 300 + 15** | 105 | 105 | — | 2 | Comparative |
| 3 | 1-3 | Step 3 | (A) + (B)* | 300 + 15** | 105 | 105 | — | 1 | Comparative |
| 4 | 1-4 | Step 4 | (A) + (B)* | 300 + 15** | 100 | 100 | — | 1 | Comparative |
| 5 | 1-5 | Step 5 | (A) + (B)* | 300 + 15** | 125 | 125 | — | 1 | Invention |
| 6 | 1-6 | Step 6 | (A) + (B)* | 300 + 15** | 130 | 130 | — | 1 | Invention |
| 7 | 1-7 | Step 7 | (A) + (B)* | 300 + 15** | 80 | 65 | — | 3 | Comparative |
| 8 | 1-8 | Step 8 | (A) + (B)* | 300 + 15** | 90 | 85 | — | 3 | Comparative |
| 9* | 1-9 | Step 8 | KI + (A) + (B) | 300 + 15*** | 100 | 100 | — | 2 | Comparative |
| 10 | 1-10 | Step 2 | (A) | 300 | 95 | 95 | — | 3 | Comparative |
| 11 | 1-11 | Step 5 | (A) | 300 | 110 | 110 | — | 1 | Invention |
| 12 | 1-12 | Step 8 | (A) | 300 | 90 | 90 | — | 2 | Comparative |
| 13 | 1-13 | Step 1 | (C) | 90 | 80 | 80 | — | 3 | Comparative |
| 14 | 1-14 | Step 6 | (C) | 90 | 120 | 120 | — | 1 | Invention |
| 15 | 1-15 | Step 7 | (C) | 90 | 75 | 75 | — | 3 | Comparative |
| 16 | 1-16 | Step 6 | (A) | 300 | 115 | 120 | — | 1 | Invention |
| 17 | 1-17 | Step 5 | (C) | 90 | 115 | 115 | — | 1 | Invention |
| 18 | 1-18 | Step 3 | (D) | 70 | 110 | — | 100 | 2 | Comparative |
| 19 | 1-19 | Step 6 | (D) | 70 | 130 | — | 130 | 1 | Invention |
| 20 | 1-20 | Step 8 | (D) | 70 | 100 | — | 100 | 3 | Comparative |

*(A) + (B) show combined use of sensitizing dyes (A) and (B) (the same in the following Tables).
**300 + 15 show the amounts added of 300 mg/AgX-1 mol of (A) and 15 mg/AgX-1 mol of (B) (the same in the following Tables).
***in this case, the amount of KI is 100 mg/AgX-1 mol.

As can be understood from Table 1, even when the samples No. 1-8 which employ the same sensitizing dyes (A) and (B) in combination, the samples No 5, 6 of the present invention in which the sensitizing dyes were added finally in the steps 5 and 6 are excellent with higher sensitivity and less stain. That is, the stain is excellent as evaluation 1, while sensitivity is by far better as compared with comparative samples. The comparative samples No. 3, 4 excellent in stain are unsatisfactory in sensitivity, and the samples of the present invention are satisfactory in all respects. Although the sample No.9 in which potassium iodide was added may be slightly more excellent as compared with the sample No. 8, it is no match for the product of the present invention. Also, among the samples No. 10 to 12 and 16 in which the sensitizing dye (A) was added, the samples No. 11 and 16 of the present invention are more excellent. Similarly, among the samples No. 13 to 15 and 17 in which the sensitizing dye (C) was added, the samples No. 14, 17 of the present invention are more excellent. Also, when the samples No. 18–20 by use of the sensitizing dye (D) are compared, the sample No. 19 of the present invention is more excellent. Thus, the samples of the present invention in which a sensitizing dye is added in the desalting step gives excellent results in all of the respects of sensitivity and stain.

EXAMPLE 2

Grain formation was conducted by adding the sensitizing dye shown in Table 2 similarly as in Example - 1 to prepare emulsions No. 2-1 to 26. In the same manner as in the above Example - 1, grains completed to the step 8 were prepared. Next, 120 of the dispersion (M-1) with the following composition, saponin and 1,2-bisvinylsulfonylethane were added, and the mixture was applied on a cellulose triacetate base support so as to give a silver quantity of 15 mg/dm$^2$ and dried to obtain a sample having stable coating. These samples are called samples No. (1)–(14).

DISPERSION (M-1):

By use of 1-(2,4,6-tricholorphenyl)-3-[3-(2,4-di-tert-amylphenoxyacetamido)-benzamidol-5-pyrazolone as the magenta coupler in an amount of $8\times10^{-2}$ mol per one mol of silver halide and 2-(1-phenyl-5-tetrazolylthiol)-4-octadecylsuccinimido-1-indanone as the DIR compounds in an amount of 0.28 mol per one mol of silver halide, these were mixed with 1-fold amount of tricresyl phosphate based on the amount of the coupler as the high boiling organic solvent, and further ethyl acetate was added to the mixture of these, followed by heating to 60° C. to completely dissolve the mixture. The solution was mixed with 50 ml of 10% aqueous solution of Alkanol B (trade name, alkylenenaphthalene sulfonate produced by Du Pont Co.) and 700 ml of a 10% aqueous solution of gelatine, and dispersion was effected by means of a colloid mill.

The samples No. (1)–(14) obtained as described above were subjected to white light exposure by means of a KS-1 Model Sensitometer (produced by Konishiroku Photo Industry K.K.) based on the JIS method, and then subjected to the color developing processing shown below.

| <Processing Step> (37.8° C.) | Processing Time |
|---|---|
| 1. Color developing | 3 min. 15 sec. |
| 2. Bleaching | 6 min. 30 sec. |
| 3. Water washing | 3 min. 15 sec. |
| 4. Fixing | 6 min. 30 sec. |
| 5. Water washing | 3 min. 15 sec. |
| 6. Stabilizing | 1 min. 30 sec. |
| 7. Drying | |
| Composition of color developing solution: | |
| 4-Amino-3-methyl-N-ethyl-N-(β-hydroxylethyl)anilinesulfate | 4.75 g |
| Anhydrous sodium sulfite | 4.25 g |
| Hydroxyamine ½ sulfate | 2.0 g |
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |
| (made up to one liter with addition of water, and adjusted to pH = 10.0) | |
| Composition of bleaching solution: | |
| Iron ammonium ethylenediaminetetraacetate | 100.0 g |
| Diammonium ethylenediaminetetraacetate | 10.0 g |
| Ammonium bromide | 150.0 g |
| Glacial acetic acid | 10.0 |
| (made up to one liter with addition of water, and adjusted to pH = 6.0 with ammonia water) | |
| Composition of fixing solution: | |
| Ammonium thiosulfate | 175.0 g |
| Anhydrous sodium sulfite | 8.6 g |
| Sodium metasulfite | 2.3 g |
| (made up to one liter with addition of water and adjusted to pH = 6.0) | |
| Composition of stabilizing solution: | |
| Formalin (37% aqueous solution) | 1.5 |
| Konidax (produced by Konishiroku Photo Industry K. K.) | 7.5 |
| (made up to one liter with addition of water) | |

For each sample obtained, sensitometry in the same manner as in white light exposure in Example - 1 was carried out, and the results obtained are shown in Table 2. In the same Table, the sensitivity is shown in terms of the reciprocal number of the exposure dosage which gives a fog of +0.1, and represented as the relative value to the sensitivity of the sample No. (5) as being 100.

TABLE 2

| Sample No. | Emulsion No. | Addition position for sensitizing dye | Kind of sensitizing dye | Amount of sensitizing dye (mg/AgX-1 mol) | White sensitivity | Invention or Comparative |
|---|---|---|---|---|---|---|
| (1) | 2-1 | Step 2 | (E) + (A) | 150 + 150 | 105 | Comparative |
| (2) | 2-2 | Step 4 | (E) + (A) | 150 + 150 | 105 | Comparative |
| (3) | 2-3 | Step 5 | (E) + (A) | 150 + 150 | 130 | Invention |
| (4) | 2-4 | Step 6 | (E) + (A) | 150 + 150 | 140 | Invention |
| (5) | 2-5 | Step 7 | (E) + (A) | 150 + 150 | 100 | Comparative |
| (6) | 2-6 | Step 8 | (E) + (A) | 150 + 150 | 90 | Comparative |
| (7) | 2-7 | Step 6 | (C) | 140 | 130 | Invention |
| (8) | 2-8 | Step 5 | (A) | 300 | 125 | Invention |
| (9) | 2-9 | Step 6 | (E) | 300 | 140 | Invention |
| (10) | 2-10 | Step 5 | (F) | 140 | 125 | Invention |
| (11) | 2-11 | Step 7 | (C) | 140 | 100 | Comparative |
| (12) | 2-12 | Step 8 | (A) | 300 | 90 | Comparative |
| (13) | 2-13 | Step 7 | (E) | 300 | 100 | Comparative |
| (14) | 2-14 | Step 7 | (F) | 140 | 95 | Comparative |

From Table 2, it can be seen that there is the same tendency as in Example - 1, and the samples No. (3), (4), (7), (8), (9) and (10) according to the present invention are excellent with high sensitivities.

EXAMPLE - 3

Into a solution prepared by dissolving 10.5 g of potassium bromide, 10 cc of a 0.5 wt.% aqueous solution of thioether ($HO(CH_2)_2S(CH_2)S(CHhd)hdOH$) and 30 g of gelatin into one liter of water and maintained at 65° C., a silver nitrate solution and a mixed solution of potassium iodide and potassium bromide were added under stirring according to the double jet method (here, the point at which the amount of the liquid added of silver halide is 50% is called the step 1', and that on completion of addition is called the step 2'; otherwise the steps are the same as in Example - 1 unless otherwise specifically noted). After completion of the addition, the temperature was dropped to 40° C., and the compound (II) and $MgSO_4$ were added in amounts of 2.4 g/AgX-1mol and 6g/AgX-1mol, respectively, to effect precipitation by lowering pH, and the supernatant was discharged to remove the soluble salts. Next, the solution was dispersed (step 3'), and post-gelatin was added thereto.

The flat plate silver halide grains had an average diameter of 1.18 μ with a thickness of 0.15 μ, and contained 2.5 mol% of silver iodide. The emulsion was chemically sensitized in the same manner as in Example - 1. The step prior to the chemical sensitization is called the step 5', and that after the sensitization is called the step 6' (in this Example, there is no step 4' corresponding to the step 4 in the above Example).

In the steps as described above, sensitizing dyes were added finally in the respective steps to give the respective emulsions No. 3-1 to 3-11 for samples No. (1) to (11) shown in Table 3. The addition positions of the dyes, the kinds and amounts of the dyes are also shown in Table 3.

Next, similarly as described in Example - 1, samples No. (1) to (11) for sensitometry comprising the above emulsions were obtained. Subsequently, exposure and processing were conducted according to the same methods as in Example - 1, and sensitivity and degree of stain were also similarly examined. The results are shown in Table 3. The sensitivity is a relative sensitivity to that of the sample No.(5) which is made 100.

TABLE 3

| Sample No. | Emulsion No. | Addition position for sensitizing dye | Kind of sensitizing dye | Amount of sensitizing dye (mg/AgX-1 mol) | White sensitivity | Green sensitivity | Invention or Comparative |
|---|---|---|---|---|---|---|---|
| (1) | 3-1 | Step 1' | (A) + (B) | 550 + 25 | 100 | 95 | Comparative |
| (2) | 3-2 | Step 2' | (A) + (B) | 550 + 25 | 115 | 115 | Comparative |
| (3) | 3-3 | Step 3' | (A) + (B) | 550 + 25 | 130 | 135 | Invention |
| (4) | 3-5 | Step 5' | (A) + (B) | 550 + 25 | 80 | 75 | Comparative |
| (5) | 3-6 | Step 5' | KI + (A) + (B) | 550 + 25**** | 100 | 100 | Comparative |
| (6) | 3-7 | Step 2' | (C) | 500 | 110 | 105 | Comparative |
| (7) | 3-8 | Step 3' | (C) | 500 | 125 | 130 | Invention |
| (8) | 3-9 | Step 5' | KI + (C) | 500**** | 95 | 95 | Comparative |
| (9) | 3-10 | Step 3' | (A) | 550 | 125 | 130 | Invention |
| (10) | 3-11 | Step 3' | (F) | 500 | 130 | 130 | Invention |

****The amount of KI (potassium iodide) in samples (5) and (8) is 200 mg/AgX-1 mol.

It can be understood from Table 3 and also from the results in this Example that the samples No. (3), (7), (9) and (10) according to the present invention have high sensitivities and also good stain characteristics.

EXAMPLE - 4

Similarly as described in Example - 3, emulsions No. 4-1 to 4-11 were prepared by addition of the sensitizing dyes shown in Table 4. Here, grains completed to the step 5' in Example - 3 were prepared. By use of the emulsions, samples No. [1]–[11] for sensitometry were prepared in the same manner as in Example - 2, and exposure and developing processing were conducted in the same manner as in Example - 2. Table 4 shows the sensitivities (relative sensitivities to that of the sample No. [4] which is made 100).

TABLE 4

| Sample No. | Emulsion No. | Addition position for sensitizing dye | Kind of sensitizing dye | Amount of sensitizing dye (mg/AgX-1 mol) | Sensitivity | Invention or Comparative |
|---|---|---|---|---|---|---|
| [1] | 4-1 | 2' | (A) + (E) | 300 + 300 | 110 | Comparative |
| [2] | 4-2 | 3' | (A) + (E) | 300 + 300 | 140 | Invention |
| [3] | 4-3 | 5' | (A) + (E) | 300 + 300 | 80 | Comparative |
| [4] | 4-4 | 5' | KI + (A) + (E) | 300 + 300***** | 100 | Comparative |
| [5] | 4-5 | 1' | (F) | 500 | 105 | Comparative |
| [6] | 4-6 | 3' | (F) | 500 | 135 | Invention |
| [7] | 4-8 | 5' | KI + (F) | 500***** | 90 | Comparative |
| [8] | 4-9 | 3' | (A) | 500 | 130 | Invention |
| [9] | 4-10 | 3' | (E) | 500 | 135 | Invention |
| [10] | 4-11 | 3' | (C) | 500 | 135 | Invention |

*****The amount of KI (potassium iodide) in samples [4] and [7] is 200 mg/AgX-1 mol.

From Table 4, the samples No. [2], [6], [8], [9]and [10] according to the present invention have higher sensitivities than comparative samples.

EXAMPLE - 5

In this Example, pressure blackening performance was examined. That is, here, 13 kinds of the materials obtained in Example - 1 were employed and controlled in humidity under the conditions of 23° C., 35% RH for 2 hours. Then, after bent by about 360° C. with a radius of curvature of 4 mm under such conditions, the material was processed with XD-90 developer by means of the KX-500 automatic developing machine.

As the result, blackening occurred at the bent portion. The degree of blackening is shown in Table 5. The degree of blackening is represented in terms of the difference (D) between the density at the blackened portion and the density of fog.

As is shown in Table 5, it can be understood that the samples No. 5, 6, 14, 16, 17 and 19 are more excellent in pressure blackening performance as compared with comparative samples. Also, it can be understood that the comparative samples No. 1, 2, 13 and 18 in which the dyes were added during or before formation of grains are particularly deteriorated in pressure blackening performance.

TABLE 5

| Sample No. in Example 1 | Degree of blackening | Invention of Comparative |
|---|---|---|
| 1 | 0.30 | Comparative |
| 2 | 0.34 | Comparative |
| 4 | 0.09 | Comparative |
| 5 | 0.05 | Invention |
| 6 | 0.04 | Invention |
| 7 | 0.07 | Comparative |
| 9 | 0.07 | Comparative |
| 13 | 0.42 | Comparative |
| 14 | 0.05 | Invention |
| 16 | 0.04 | Invention |
| 17 | 0.05 | Invention |
| 18 | 0.36 | Comparative |
| 19 | 0.05 | Invention |

As described above, the light-sensitive silver halide photographic material of the present invention can exhibit fully the effect of the spectral sensitizing dye, and has the effects of high sensitivity, and yet small stain and also good performance to pressure blackening.

EXAMPLE 6

Emulsion 6-1 was prepared by use of the same seed crystal as used in Example 1 in the same manner as for emulsion 1-9 in Example 1 except that amount of the seed crystal was 40 % of the amount used for the emulsion 1-9 in Example 1.

Similarly, emulsion 6-2 was prepared by use of the same seed crystal as used in Example 1 in the same manner as for emulsion 1-6 in Example 1 except that the amount of the seed crystal was 40 % of the amount used for the emulsion 1-6 in Example 1.

The thus obtained emulsions had an average grain size of 0.7 μm and a silver iodide content of 2 mol%.

Further, emulsion 6-3 and emulsion 6-4 were prepared by use of the same seed crystal as used in Example 1 in the same manner as for emulsion 1-9 and for emulsion 1-6 in Example 1, respectively, except that the amount of the seed crystal is 2.5 times the amount used for emulsion 1-9 and 1-6 in Example 1.

The thus obtained emulsions had an average grain size of 0.48 μm and a silver iodide content of 2 mol%.

Next, emulsions 6-1, 6-2, 6-3 and 6-4 in Example 6, emulsions 1-9 an 1-6 in Example 1 and emulsions 3-6 and 3-3 in Example 3 were mixed at a ratio as shown in Table 6 in the same manner as in Example 1 to prepare samples Nos. I to IX shown in Table 6.

Following the same procedure as in Example 1, white sensitivity and stain of the thus obtained samples were evaluated. The results obtained are shown in Table 6.

TABLE 6

| No. | Emulsion No. | | | Ratio of mixing | | | White sensitivity | Stain | Invention or Comparative |
|---|---|---|---|---|---|---|---|---|---|
| I | 6-1 | 1-9 | 6-3 | 20% | 50% | 30% | 100 | 3 | Comparative |
| II | 6-1 | 1-9 | 6-4 | 20% | 50% | 30% | 110 | 2 | Invention |
| III | 6-1 | 1-6 | 6-4 | 20% | 50% | 30% | 125 | 1 | Invention |
| IV | 6-2 | 1-6 | 6-4 | 20% | 50% | 30% | 130 | 1 | Invention |
| V | 6-1 | 1-6 | 6-3 | 20% | 50% | 30% | 120 | 1 | Invention |
| VI | 3-6 | | 6-3 | 70% | | 30% | 90 | 3 | Comparative |
| VII | 3-6 | | 6-4 | 70% | | 30% | 105 | 2 | Invention |
| VIII | 3-3 | | 6-3 | 70% | | 30% | 115 | 1 | Invention |
| IX | 3-3 | | 6-4 | 70% | | 30% | 125 | 1 | Invention |

As is seen from Table 6, samples in which at least one of emulsions constituting the emulsion layer is the emulsion according to the present invention (samples Nos. II, III, IV, V, VII, VIII and IV) have high sensitivity and little stain.

We claim:

1. In a light-sensitive silver halide photographic material having a photographic emulsion containing a spectral sensitizing dye and being prepared by respective steps of formation of silver halide grains in an aqueous gelatin solution, physical ripening and desalting followed further by chemical sensitization, the improvement wherein the spectral sensitizing dye is added to the emulsion during the desalting step, whereby little stain results and good pressure blackening performance is obtained for the photographic material.

2. The light-sensitive silver halide photographic material according to claim 1, wherein said desalting step is effected by use of a sulfate, polystyrylsulfonic acid type polymer or a vinyl polymer having carboxylic acid.

3. The light-sensitive silver halide photographic material according to claim 1, wherein said addition of a spectral sensitizing dye is effected before entering of post-gelatin.

4. The light-sensitive silver halide photographic material according to claim 1, wherein after said first addition of a spectral sensitizing dye and before chemical sensitization, the same or different spectral sensitizing dye is added to the silver halide grains.

5. The light-sensitive silver halide photographic material according to claim 1, wherein pH of the emulsion during said desalting step is within the range of from 3.5 to 9.5 and pH of the emulsion during said addition of the spectral sensitizing dye is within the range of from 6.0 to 9.5.

6. The light-sensitive silver halide photographic material according to claim 1, wherein pAg of the emulsion during said desalting step is within the range of from 4.9 to 12.5 and pAg of the emulsion during said addition of the spectral sensitizing dye is within the range of from 8.0 to 12.5.

7. The light-sensitive silver halide photographic material according to claim 1, wherein said spectral sensitizing dye is selected from the group consisting of cyanine dyes and merocyanine dyes and complex merocyanine dyes.

8. The light-sensitive silver halide photographic material according to claim 1, wherein the grains of said silver halide comprises silver iodobromide having the average silver iodide content of 0.1 to 10 mol%.

9. The light-sensitive silver halide photographic material according to claim 1, wherein the grains of said silver halide have the average grain size of 0.2 to 8.0μm.

10. The light-sensitive silver halide photographic material according to claim 1, wherein said emulsion is mono-dispersed one.

11. The light-sensitive silver halide photographic material according to claim 1, wherein the amount of silver coated on said material is within the range from 1000 mg/m$^2$ to 15000 mg/m$^2$.

12. The light-sensitive silver halide photographic material of claim 6 wherein said desalting step is effected by use of a sulfate, and said spectral sensitizing dye is selected from the group consisting of cyanine dyes, merocyanine dyes and complex merocyanine dyes.

13. The light-sensitive silver halide photographic material according to claim 12, wherein the grains of said silver halide comprises silver iodobromide having an average silver iodide content of 0.1 to 10 mol% and having an average grain size of 0.2 to 8.0μm.

* * * * *